US005123863A

United States Patent [19]

Frederick et al.

[11] Patent Number: 5,123,863

[45] Date of Patent: Jun. 23, 1992

[54] SOLDERLESS HOUSING INTERCONNECT FOR MINIATURE SEMI-RIGID COAXIAL CABLE

[75] Inventors: Albert H. Frederick, Huntington Beach; Clifford B. Perry, Manhattan Beach, both of Calif.

[73] Assignee: TRW Inc., Redondo Beach, Calif.

[21] Appl. No.: 729,672

[22] Filed: Jul. 15, 1991

[51] Int. Cl.[5] ..... H01R 13/00

[52] U.S. Cl. ..... 439/578; 439/581

[58] Field of Search ..... 439/578-585

[56] References Cited

U.S. PATENT DOCUMENTS

| | | | |
|---|---|---|---|
| 1,214,183 | 1/1917 | Krantz | 439/581 |
| 3,364,457 | 1/1968 | Veith et al. | 439/581 |
| 3,573,687 | 4/1971 | Watanabe | 439/581 |
| 4,012,105 | 3/1977 | Biddle | 439/581 |

*Primary Examiner*—Joseph H. McGlynn

*Attorney, Agent, or Firm*—G. Gregory Schivley; Ronald L. Taylor

[57] ABSTRACT

An improved miniature interconnect (10) for detachably introducing a transmission line (12) to a corresponding medium (20) through a passage in a barrier (18). This interconnect (10) comprises a fastening means (36), coupled to the transmission line (12) for directly engaging the passage such that the transmission line (12) is removably retained in a held relationship with respect to the barrier (18). A conducting means (38) for establishing electrical contact between the transmission line (12) and the corresponding medium (20) is disposed within the passage and is engaged by both the transmission line (12) and the corresponding medium (20). This conducting means (38) further provides a sealing means (42) for sealing the passage through the barrier (18).

23 Claims, 2 Drawing Sheets

SOLDERLESS HOUSING INTERCONNECT FOR MINIATURE SEMI-RIGID COAXIAL CABLE

BACKGROUND AND SUMMARY OF THE INVENTION

This invention relates generally to a connector for transmission lines and more specifically to an interconnect for terminating a miniature semi-rigid coaxial cable to achieve a hermetically sealed coaxial cable to printed circuit board microstrip transition capable of carrying high frequency signals.

Conventional coaxial cables are used in numerous applications to carry and distribute radio, microwave and other signals. Coaxial cable connectors are often used to connect coaxial cables to one another and to connect coaxial cables to electrical devices. Such connectors are often employed in harsh environments that are compact in nature such as defense systems, machinery, air and ground vehicles and space applications. It is therefore desirable to provide a miniature, simple, low-cost, hermetically sealed coaxial cable interconnect that does not limit the operating frequency usage, and provides make and break flexibility.

While existing prior art connectors have attempted to achieve these results, they typically have contained a multitude of components which increases both the connectors' cost and size. Additionally, these connectors often require expensive custom tools to maintain and operate the connectors, thereby making off-site service difficult and expensive. Accordingly, the present invention provides a miniature interconnect that achieves the desired results while maintaining the small, simple, low cost features. This is accomplished by having fastening means and retaining means engage the barrier to hold the terminating end of the cable in place within the passage. The terminating end of the cable engages with conducting means disposed within the passage to establish electrical contact between the coaxial cable conductor and a conductor on the opposite side of the barrier.

One advantage of the present invention is its simple construction, minimal number of components, durability and the ease with which it is maintained.

Another advantage of the present invention is its compactness which allows these interconnects to be mounted in very close proximity to one another.

Another advantage of the present invention is its ability to create a hermetic seal within the passage in the barrier.

A further advantage of the present invention is that the correct impedance is maintained across the interconnect as electrical contact is established between a conductor on one side of a barrier and a second conductor on the other side of the barrier in such a manner as to provide a low loss, high frequency AC transmission media.

Yet another advantage of the present invention is the ability of this interconnect to be quickly and easily connected to and disconnected from the barrier numerous times without requiring soldering and without damaging the characteristics of the interconnect.

Additional objects, advantages, and features of the present invention will become apparent from the following description and claims, taken in conjunction with the accompanying drawings.

DETAILED DESCRIPTION OF THE PREFERRED EMBODIMENT

Figure 1:
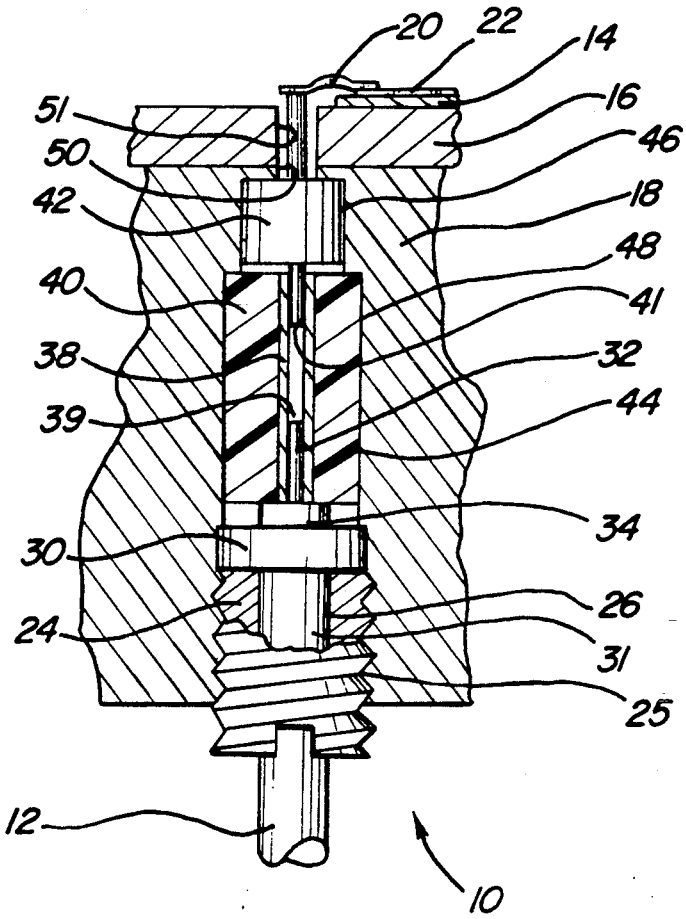
FIG. 1 is a fragmentary cross sectional illustration of the preferred embodiment of the interconnector of the present invention shown in use with a printed circuit board, the view being taken along section 1—1 in FIG. 4.
Figure 2:
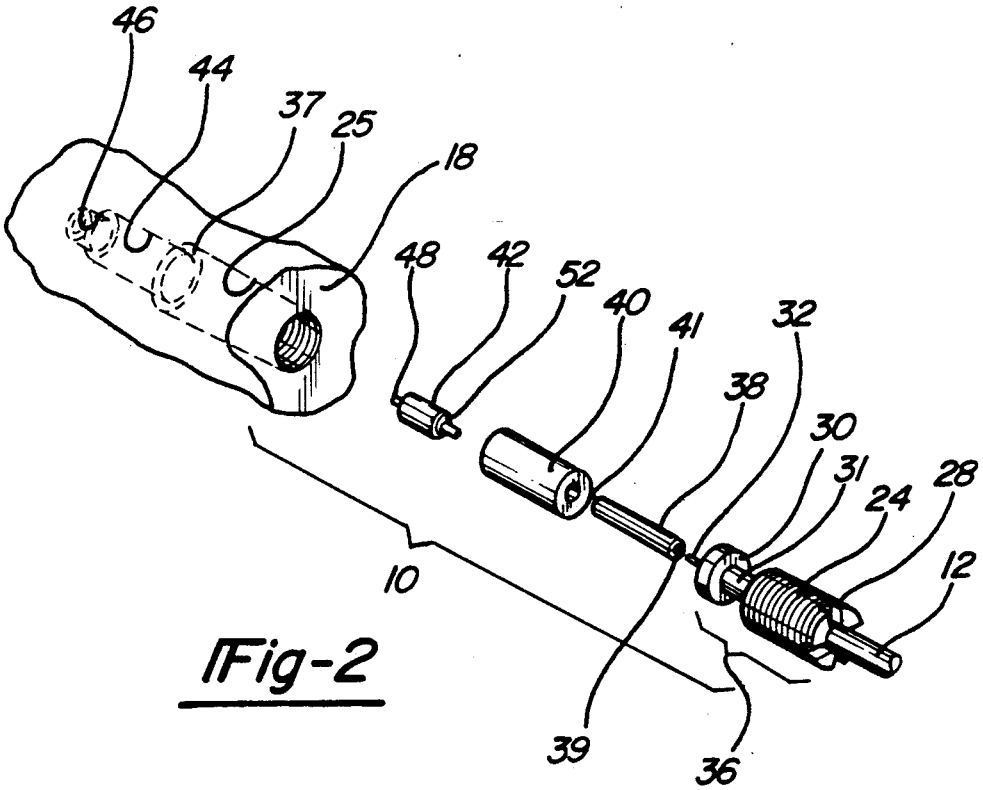
FIG. 2 is an exploded perspective view of the interconnect.
Figure 3:
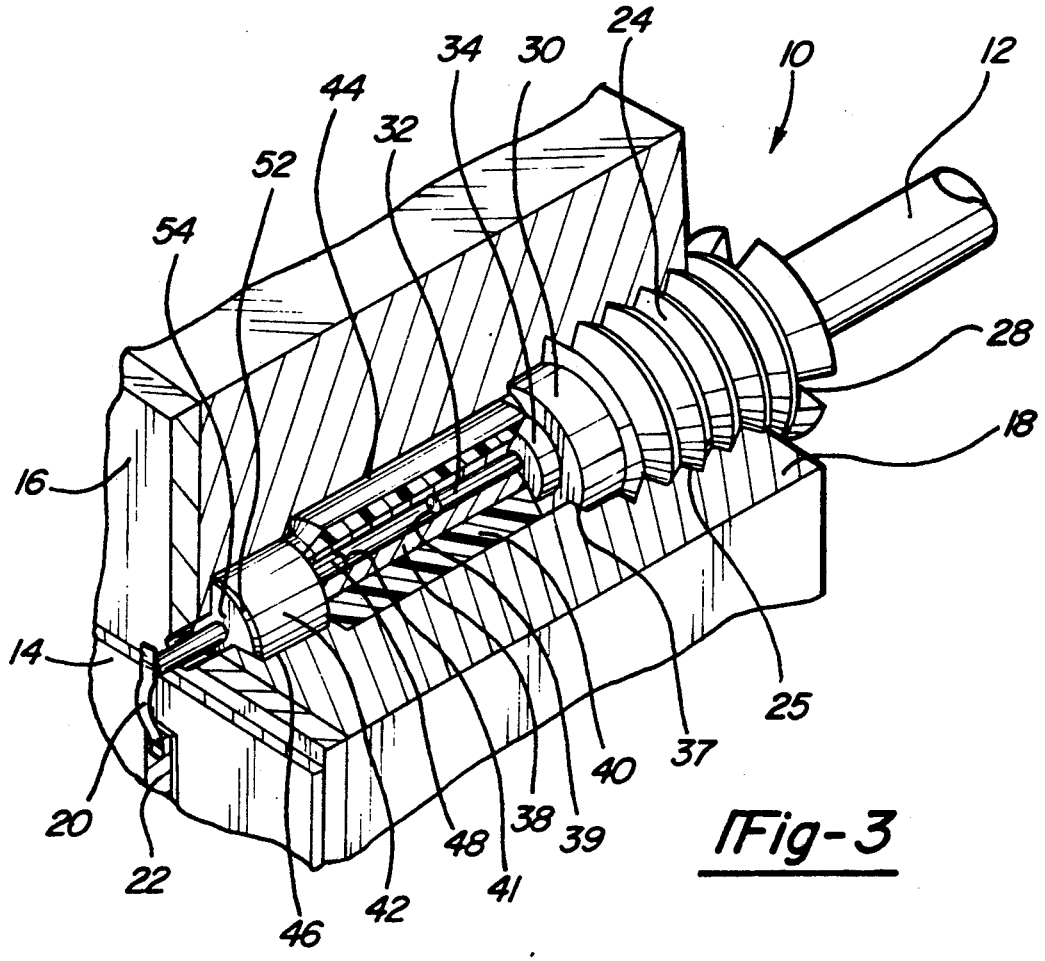
FIG. 3 is a cutaway perspective view of the interconnect.
Figure 4:
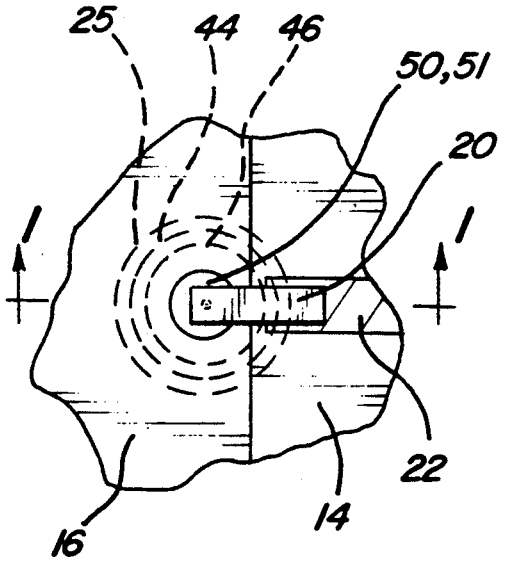
FIG. 4 is a top view showing the ribbon cable connected to both an RF feedthrough pin and a microstrip conductor on a printed circuit board.
Figure 5:
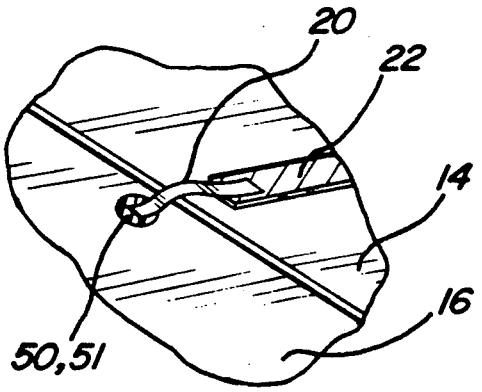
FIG. 5 is a perspective view of the RF feedthrough pin making electrical contact with the microstrip conductor via the ribbon cable shown in FIG. 4.

An improved miniature high frequency interconnect 10 for detachably introducing a transmission line to a corresponding medium through a barrier is indicated generally in FIGS. 1, 2 and 3. The transmission line shown in FIG. 1 is a conventional semi-rigid miniature coaxial cable 12; the barrier in FIG. 1 is a conventional printed circuit board substrate 14 and carrier 16 mounted on a device housing wall 18. Other barriers may include a bulkhead or the like utilized as a connection point for transmission lines. In this embodiment, the corresponding medium to which the coaxial cable 12 is coupled is a ribbon cable 20 connected to a microstrip conductor 22 on the printed circuit board substrate 14 as best shown in FIGS. 4 and 5.

Fasteners are employed to introduce and terminate the coaxial cable 12 within a passage defined by the housing wall 18 such that the coaxial cable 12 is removably retained in a held relationship with respect to the ribbon cable 20. Preferably, the fasteners utilized include a tubular jam nut 24 which threadingly engages with a threaded portion 25 of the passage in the housing wall 18. The tubular jam nut 24, shown more clearly in FIG. 2, is externally threaded along its entire length and contains an axial throughway 26, as shown in FIG. 1, passing through its axial center. This throughway 26 is of sufficient diameter to allow the coaxial cable 12 to pass through it. Accordingly, the jam nut 24 passes over the coaxial cable outer diameter and moves freely along the axial length of the coaxial cable 12. The outer portion of the jam nut 24 contains a crosshatched depression 28. The crosshatched slots or depressions 28 allows a tool to rotationally turn the jam nut 24, thereby allowing threading engagement and disengagement of the jam nut 24 with the housing wall 18. This engagement-/disengagement provides a simple solderless connect-/disconnect means.

With the coaxial cable 12 passed through the externally threaded jam nut throughway 26, a cylindrical retaining ring 30 is then permanently affixed to the terminating end of the coaxial cable 12. As best shown in FIG. 3, the retaining ring 30 has an inside diameter of sufficient size to allow it to slide over the coaxial cable 12 outer conductor—hereinafter referred to as the shield 31. Once the retaining ring 30 is slid over the end of the shield 31, the ring 30 is permanently affixed to the shield 31, preferably by soldering, such that a portion of the inner conductor 32 and the inner insulator 34 of the coaxial cable 12 extends axially from the retaining ring- /jam nut assembly 36, as shown in FIGS. 1 and 2. The extending portion of the inner insulator 34 assures that the inner conductor 32 will not short out with the retaining ring 30. Note that the outer diameter of the retaining ring 30 is small enough to allow it to pass freely through the threaded portion 25 of the passage and abut an inner shelf 37 within the passage. Accordingly, the shield 31 is coupled to the housing wall 18 via the retaining ring 30 thereby providing a conductive path from the shield 31 to the housing wall 18.

The retaining ring/jam nut assembly 36, as shown in FIG. 2, is assembled prior to fastening the coaxial cable 12 to the housing wall 18. Once assembled, a solderless make and break connection can be made with the housing wall 18 by threadingly engaging and disengaging the jam nut 24. This connection is adjustable with respect to the barrier by utilizing retaining rings having varying thicknesses. In addition, because of the simple construction and relatively few parts involved, this assembly is quite small which allows interconnect 10 spacing less than 0.17 inches center to center between two mounted interconnects 10.

As best shown in FIGS. 1, 2 and 3, a conductor is utilized to establish electrical contact between the coaxial cable 12 on one side of the barrier and the ribbon cable 20 connected to the printed circuitboard microstrip conductor 22 on the opposite side of the barrier. This conductor is disposed within the passage and includes a female contact 38, a dielectric insulator 40 and a conventional RF feedthrough 42 such as a Wilton K-100. As shown best in FIG. 1, the exposed inner conductor 32 of the coaxial cable 12 extends from within the retaining ring 30 and is inserted into the female contact 38. This female contact 38 has axial bores 39 and 41. The axial bore 39 is designed to accept the inner conductor 32 of the coaxial cable 12. The inner conductor 32 is permanently affixed to the female contact 38, preferably by soldering. The axial bore 41 is designed to accept the RF feedthrough pin 48. The female contact 38 is disposed within a tubular dielectric insulator 40 that is preferably made of a material such as teflon; the female contact 38 is preferably made of a conductive material such as beryllium copper. Both the tubular dielectric 40 and the female contact 38 are disposed within a counterbore diameter 44 in the passage as shown in FIGS. 1 and 2.

The RF feedthrough 42 is disposed, preferably by soldering, within a second counterbore 46 at the innermost portion of the housing wall 18. One should note that the RF feedthrough 42 provides a hermetic seal when soldered within the counterbore 46. The RF feedthrough pin 48 extends axially through the RF feedthrough 42 and serves as a conductor that establishes electrical contact between the female contact 38 and the ribbon cable 20. As best shown in FIG. 1, one side of the RF feedthrough pin 48 is inserted into the female contact 38 thereby making electrical contact with the inner conductor 32. The other side of the RF feedthrough pin 48 extends outwardly through apertures 50 and 51 in the housing wall 18 and the carrier 16, to enable connection with the printed circuit board microstrip conductor 22 as shown best in FIGS. 3, 4 and 5. This outwardly extending RF feedthrough pin 48 is attached to a printed circuit board microstrip conductor 22 via a ribbon cable 20 which is preferably welded by a thermocompression method to both the microstrip conductor 22 and the RF feedthrough pin 48. The ribbon cable 20 thereby completes the electrical connection of the innerconductor 32 to the printed circuit board microstrip conductor 22.

A 50 ohm impedance is maintained throughout the complete electrical transition from the coaxial cable 12 to the microstrip conductor 22. However, one of ordinary skill in the art would recognize that an impedance other than 50 ohms could be maintained across this electrical transition. The 50 ohm impedance is achieved by maintaining a coaxial cable type structure throughout the passage within the housing wall 18 and carrier 16. This structure consists of an outer conductor provided by way of the retaining ring 30, housing wall 18, RF feedthrough outer jacket 52 and carrier 16. The inner conductor includes the contact 38 and RF feedthrough pin 48. The insulation maintained between the two conductors is provided by the teflon dielectric insulator 40 and the glass composite 54 within the RF feedthrough 42. The diameter of the inner conductor, size of the outer conductor, distance between both conductors and type of dielectric and conductor used are all selected to maintain the 50 ohm impedance throughout.

In the preferred embodiment, the coaxial cable type construction has the following dimensions and characteristics. The teflon dielectric insulator 40 has an outer diameter of 0.092 inches and a dielectric constant of 2.1. The outer diameter of the female contact 38 is 0.0275 inches; the outer diameter of the inner conductor 32 and RF feedthrough pin 48 is 0.012 inches. The apertures 50 and 51 in the housing 18 and the carrier 16 each have a diameter of 0.028 inches, and accordingly a portion of the RF feedthrough pin 48 passing through these apertures is surrounded by air. This air serves as the dielectric insulator about the RF feedthrough pin 48 and has an approximate dielectric constant of 1, which is lower than that of teflon. This lower dielectric constant of air is the determining factor for selecting the small diameter ($d=0.028$ inches) of the apertures 50 and 51 in order to maintain the correct impedance.

The coaxial cable type construction ends as the RF feedthrough pin 48 exits the apertures 50 and 51 and is exposed to an open atmosphere. This exposure increases the impedance of the RF feedthrough pin 48 which therefore operates as a series inductance. To compensate for the higher impedance and series inductance, a 0.010 inch wide gold ribbon cable 20 such as from Sigmand Cohn Corp. is used to create a shunt capacitance. This capacitance is created by the ribbon cable 20 and carrier 16 acting as parallel plates to set up a capacitance. Thus, the width of the ribbon 20 is controlled to create adequate shunt capacitance to match the series inductance of the RF feedthrough pin 48. Accordingly, because of the capacitance/inductance matching, the 50 ohm impedance is controlled and maintained across the exposed portion of the RF feedthrough pin 48. Thus, a 50 ohm impedance is maintained throughout the complete electrical connection from the conventional 50 ohm coaxial cable 12 to the conventional 50 ohm printed circuit board.

The foregoing discussion discloses and describes merely the exemplary embodiments of the present invention. One skilled in the art will recognize from such discussion, and from the accompanying drawings and claims, that various changes, modifications and variations can be made without departing from the spirit and scope of the invention as defined in the following claims.

We claim:

1. An improved miniature high frequency interconnect for detachably introducing a coaxial cable to a conductive medium through a passage in a barrier, said improvement comprising:

(a) fastening means coupled to said coaxial cable for directly engaging said barrier such that said coaxial cable is detachably retained in a held relationship with respect to said barrier, wherein said fastening means includes a retaining ring affixed to an outer conductor of said coaxial cable at an end of said coaxial cable that terminates within said passage, and an externally threaded tubular nut through which said coaxial cable extends, thereby providing means for trapping said retaining ring against an inner shelf in said passage by engaging said nut with a threaded portion of said passage in said barrier thereby securing said coaxial cable with respect to said medium; and (b) conducting means disposed in said passage for establishing high frequency electrical contact between said coaxial cable and said medium, wherein said miniature high frequency interconnect maintains a substantially fixed impedance across the entire connection from the coaxial cable to the conductive medium.

2. The interconnect of claim 1 wherein said medium comprises a ribbon cable in contact with a microstrip conductor on a printed circuit board.

3. The interconnect of claim 1 wherein said barrier is a portion of a device housing.

4. The interconnect of claim 1 wherein said barrier is a portion of a printed circuit board.

5. The interconnect of claim 1 wherein said barrier is a portion of a bulkhead.

6. The interconnect of claim 1 wherein said miniature interconnect maintains a substantially constant 50 ohm impedance across the entire connection from the coaxial cable to the conductive medium.

7. The interconnect of claim 1 wherein said conducting means provides a seal within said passage.

8. The interconnect of claim 7 wherein said seal comprises an RF feedthrough soldered within said passage between said coaxial cable and said medium.

9. The interconnect of claim 7 wherein said conducting means comprises a female contact that engages an inner conductor of said coaxial cable at one end and the RF feedthrough at an opposite end thereof.

10. The interconnect of claim 9 wherein said female contact is surrounded by a dielectric insulator.

11. An improved miniature high frequency interconnect for detachably terminating a coaxial cable within a passage in a barrier, comprising:

(a) fastening means for detachably terminating said coaxial cable within said passage, wherein said fastening means includes a retaining ring affixed to an outer conductor of said coaxial cable at an end of said coaxial cable that terminates within said passage, and an externally threaded tubular nut through which said coaxial cable extends, thereby providing means for trapping said retaining ring against an inner shelf in said passage by engaging said nut with a threaded portion of said passage in said barrier; and (b) conducting means disposed in said passage for establishing electrical contact between a microstrip conductor on a printed circuit board and said coaxial cable.

12. The interconnect of claim 11 wherein said medium comprises a ribbon cable in contact with a microstrip conductor on a printed circuit board.

13. The interconnect of claim 11 wherein said barrier is a portion of a device housing.

14. The interconnect of claim 11 wherein said barrier of a printed circuit board.

15. The interconnect of claim 11 wherein said barrier a portion of a bulkhead.

16. The interconnect of claim 11 wherein said miniature interconnect maintains a substantially constant 50 ohm impedance across the entire connection from the coaxial cable to the conductive medium.

17. The interconnect of claim 11 wherein said conducting means provides a seal within said passage.

18. The interconnect of claim 17 wherein said seal comprises a RF feedthrough soldered within said passage between said coaxial cable and said medium.

19. The interconnect of claim 17 wherein said conducting means comprises a female contact that engages an inner conductor of said coaxial cable at one end and the RF feedthrough at an opposite end thereof.

20. The interconnect of claim 19 wherein said female contact is surrounded by a dielectric insulator.

21. An improved method for removably connecting a coaxial cable directly to a barrier with a high frequency interconnect such that electrical contact can be readily established, through a passage defined by said barrier, between said coaxial cable which terminates on one side of said barrier and a medium located on the opposite side of said barrier, said method comprising the steps of:

(a) fastening said high frequency interconnect directly to said barrier by turning an exterior threaded tubular nut into a threaded portion of said passage, such that the end of said coaxial cable containing a retaining ring affixed to the outer conductor of said coaxial cable terminates within said passage in said barrier by trapping said retaining ring against an inner shelf in said passage, thereby removably retaining said coaxial cable in a held relationship with respect to said barrier; and (b) adjusting said interconnect such that proper contact is maintained between an inner conductor of said coaxial cable and a conducting means disposed in said passage.

22. The method of claim 21 wherein said step of adjusting said interconnect involves turning said tubular nut within a threaded portion of said passage such that said coaxial cable is displaced according into a desired position.

23. The method of claim 22 wherein said step of removing said interconnect from said barrier involves turning said threaded nut such that said nut becomes disengaged from the threaded portion of said passage thereby removing the cable from said barrier.

* * * * *